US008764043B2

(12) United States Patent
Neubauer et al.

(10) Patent No.: US 8,764,043 B2
(45) Date of Patent: Jul. 1, 2014

(54) SPLITBOARD BINDING

(71) Applicant: K-2 Corporation, Seattle, WA (US)

(72) Inventors: Jason Neubauer, Redmond, WA (US); Nigel Bruce Edward Steere, Seattle, WA (US)

(73) Assignee: K-2 Corporation, Seattle, WA (US)

( * ) Notice: Subject to any disclaimer, the term of this patent is extended or adjusted under 35 U.S.C. 154(b) by 0 days.

(21) Appl. No.: 13/922,161

(22) Filed: Jun. 19, 2013

(65) Prior Publication Data

US 2013/0341889 A1 Dec. 26, 2013

Related U.S. Application Data

(60) Provisional application No. 61/662,120, filed on Jun. 20, 2012.

(51) Int. Cl.

| | |
|---|---|
| ***A63C 5/00*** | (2006.01) |
| ***A63C 9/02*** | (2012.01) |
| ***A63C 5/02*** | (2006.01) |
| ***A63C 10/16*** | (2012.01) |
| ***A63C 5/03*** | (2006.01) |
| ***A63C 10/14*** | (2012.01) |

(52) U.S. Cl.

CPC . *A63C 10/16* (2013.01); *A63C 9/02* (2013.01); *A63C 5/02* (2013.01); *A63C 2203/06* (2013.01); *A63C 5/03* (2013.01); *A63C 10/14* (2013.01)

USPC ..... 280/607

(58) Field of Classification Search

USPC ..... 280/607–634

See application file for complete search history.

(56) References Cited

U.S. PATENT DOCUMENTS

| | | | | |
|---|---|---|---|---|
| 5,553,883 | A * | 9/1996 | Erb | 280/607 |
| 5,558,354 | A * | 9/1996 | Lion | 280/607 |
| 5,660,416 | A | 8/1997 | Schiele | |
| 5,984,324 | A * | 11/1999 | Wariakois | 280/14.24 |
| 6,000,711 | A * | 12/1999 | Fey et al. | 280/603 |
| 7,823,905 | B2 * | 11/2010 | Ritter | 280/618 |
| 8,033,564 | B2 | 10/2011 | Riepler | |
| 8,226,109 | B2 | 7/2012 | Ritter | |
| 8,469,372 | B2 * | 6/2013 | Kloster et al. | 280/14.22 |

(Continued)

OTHER PUBLICATIONS

Partial European Search Report mailed Oct. 2, 2013, issued in corresponding Application No. EP 13 17 2946.9, filed Jun. 20, 2013, 4 pages.

*Primary Examiner* — John Walters
*Assistant Examiner* — James Triggs
(74) *Attorney, Agent, or Firm* — Christensen O'Connor Johnson Kindness PLLC

(57) ABSTRACT

A splitboard (90) having a first ski (92L) releasably attachable to a second ski (92R) and operable in a snowboard mode and in a ski mode. Corresponding toe brackets (140) are attached to the first and second skis. A pair of forward slider blocks (130) and a pair of rear slider blocks (130) are attached to the first and second skis. Left and right bindings (100L, 100R) include front hook portions (116) configured to releasably engage the corresponding toe brackets. The bindings are configured to slidably engage the forward and rear slider blocks in snowboard mode. Pull loops (120) are pivotable between a lock position, wherein a blocking portion (123) of the pull loop extends through an aperture in the binding to engage the slider block in the lock position. A heel stop (112) extends down from the binding to limit the forward slide of the binding.

20 Claims, 9 Drawing Sheets

(56) References Cited

U.S. PATENT DOCUMENTS

| | | | | |
|---|---|---|---|---|
| 8,708,371 | * | 4/2014 | Balun | 280/818 |
| 2001/0038192 | A1* | 11/2001 | McManus et al. | 280/601 |
| 2002/0017771 | A1* | 2/2002 | McManus et al. | 280/600 |
| 2010/0102522 | A1 | 4/2010 | Kloster | |
| 2012/0256395 | A1 | 10/2012 | Ritter | |
| 2012/0274036 | A1* | 11/2012 | Kloster et al. | 280/11.31 |

* cited by examiner

SPLITBOARD BINDING

CROSS-REFERENCE TO RELATED APPLICATION

This application claims the benefit of U.S. Provisional Application No. 61/662,120, filed Jun. 20, 2012, the entire disclosure of which is incorporated by reference herein.

BACKGROUND

An inherent disadvantage of snowboards is that they have limited backcountry range away from lift systems. Because a snowboard is a single gliding board, and the bindings attach both of the rider's feet to the snowboard, the rider is substantially restricted to downhill travel. Splitboards have been developed as a hybrid gliding board system that enables backcountry snowboarding where pristine powder snow is more likely to be found.

A splitboard is a gliding board for use on snowy terrain. The splitboard can be configured to function in a snowboard mode, wherein two ski-like gliding boards are joined together to function as a single gliding board. In snowboard mode, the bindings are configured to bind the rider's boots to the board with both feet oriented transverse to the splitboard. The splitboard can alternatively be used in a ski mode with the two separate ski-like gliding boards separated, and the bindings configured to bind the rider's boots longitudinally on the gliding boards.

Splitboarding started in the mid-1990s and has grown in popularity in recent years. Splitboards configured in ski mode enable snowboarders to hike up snow covered hills. The rider configures the bindings in a longitudinal ski mode and optionally attaches a traction system such as climbing skins to the bottom surface of the individual skis. When climbing a hill in ski mode, the bindings preferably allow the rider's foot to pivot at the toe, enabling the heel to lift away from the ski.

When a desired elevated position is reached, the individual skis are joined, and the bindings are reconfigured to a transverse snowboard mode to allow the rider to snowboard down the hill. In snowboard mode, the bindings preferably lock the boots securely to the board, toe, and heel to prevent significant movement independent of the board.

Modern splitboard bindings have been designed to reduce the weight associated with an adapter plate/standard binding combination. The reduced weight is crucial in increasing range and duration of extended uphill climbs.

An exemplary splitboard system is disclosed in U.S. Pat. No. 5,984,324, to Wariakois, which is hereby incorporated by reference. Another splitboard system is disclosed in U.S. Pat. No. 7,823,905, to Ritter, which is hereby incorporated by reference.

In the binding system disclosed in Wariakois (using reference numerals from Wariakois), the heel-side ski member 12 has forward and rearward heel slider blocks 60 fixed to the ski member 12. The toe-side ski member 14 has forward and rearward toe slider blocks 58 fixed to the ski member 14. When the ski members 12, 14 are joined for snowboard mode operation, the two forward slider blocks 58, 60 are aligned to slidably engage the left-foot binding 70 base plate 74, and the two rearward slider blocks 58, 60 are aligned to slidably engage the right-foot binding 70 base plate 74. The base plates 74 define lateral and medial U-shaped channels 84 that slidably receive laterally extending flanges 88 on the slider blocks 58, 60. The base plate 74 includes a fixed heel stop 90 extending downwardly from a rear end of the base plate 74. The heel stop 90 is positioned to contact the rear edge of the heel slider block 60 as the base plate 74 is slid fully forward on the slider blocks 58, 60. The user then inserts a pin 94 through aligned apertures 96 provided on the front end of the base plate 74. The pin 94 is positioned to engage the front edge of the toe slider block 58, and, therefore, prevents the base plate 74 from sliding rearward on the slider blocks 58, 60.

Each of the ski members 12, 14 is also provided with a separate toe bracket 130 fixed to the ski member between the toe and heel slider blocks 58, 60. The base plates 74 are each attached to the corresponding toe bracket 130 in ski mode by removing the pin 94, sliding the base plate 74 off of the slider blocks 58, 60, aligning the base plate forward apertures 96 with corresponding apertures 142 on the toe bracket 130, and inserting the pin 94 through the apertures 96, 142. The binding 70 is thereby attached to the gliding board and is pivotable about the pin 94 (unless the user also engages a heel bracket 132 that is provided on the ski).

The binding system disclosed in Wariakois performs its intended purpose. However, removing and replacing the pin to switch between ski mode and snowboard mode can be challenging, particularly in the snowy and icy conditions where the operation must be performed, and particularly in bulky ski gloves. Moreover, switching from ski mode to snowboard mode requires removing the pin, which introduces the risk of the pin becoming lost in the snow.

The present invention is directed to a connection system, or binding, that can easily be switched between ski mode and snowboard mode operation.

SUMMARY

This summary is provided to introduce a selection of concepts in a simplified form that are further described below in the Detailed Description. This summary is neither intended to identify key features of the claimed subject matter, nor is it intended to be used as an aid in determining the scope of the claimed subject matter.

A splitboard binding includes a base plate configured to be releasably attached to both a right gliding board and a left gliding board in a snowboard mode, and to be releasably attached to only a corresponding one of the right and left gliding boards in a ski mode. The base plate includes a circular hook portion at a forward end. A toe bracket is attached to the corresponding gliding board. The toe bracket includes a first circular channel that is configured to slidably engage the circular hook portion. The circular hook portion and circular channel are shaped and sized such that the base plate can engage or be released from the toe bracket only when the base plate is disposed at a predetermined release angle measured with respect to the corresponding gliding board. For example, the base plate may engage or disengage with the toe bracket only when the base plate is at an angle of at least 75 degrees from the gliding board. In an embodiment the release angle is at least 90 degrees.

In an embodiment the toe bracket includes a saddle portion defining an outer wall of the circular channel, and a rod portion defining an inner wall of the circular channel. In an embodiment the base plate has two circular hook portions that engage two corresponding circular channels in the toe bracket. In an embodiment, the toe bracket includes left and right hubs, each hub having a saddle portion and a tubular portion.

In an embodiment the binding further comprises left and right slider blocks fixed to the left and right gliding boards respectively, and the base plate slidably engages the slider blocks in the snowboard mode. The binding may further include a means for locking the base plate to the slider blocks during use. For example, the locking means may be a blocking element pivotably attached to the base plate, and pivotable to engage one end of a slider block, and a heel stop extending downwardly from the base plate and positioned to engage an opposite end of the slider block.

In another aspect of the invention a splitboard includes left and right gliding boards that are configured to be selectively connected in a snowboard mode, or to be unconnected in a ski mode. Left and right toe brackets, each defining a circular channel, are attached to the left and right gliding boards, respectively. Left and right bindings include base plates with circular hooks that are configured to slidably engage the corresponding circular channels in ski mode, wherein the base plates cannot be removed from slidable engagement unless they are oriented at an angle equal to or greater than a predetermined release angle, for example 75 degrees. Means are provided for attaching the left and right base plates to both of the gliding boards in snowboard mode.

In an embodiment the circular channels are defined by saddle portions on the toe brackets and circular rod portions on the toe brackets. In an embodiment, the base plates each have two circular hooks, and the toe brackets each have two circular channels that are positioned to slidably receive both of the circular hooks on the corresponding base plate.

In an embodiment the means for attaching the base plates to the gliding boards in snowboard mode include a front pair of slider blocks and a rear pair of slider blocks, wherein the slider blocks art and base plates are configured to slidably engage. Means for slidably locking the base plates to the slider blocks are also provided, for example a pivotable pull loop with a blocking element, and a heel stop.

In an embodiment the left and right bindings are reconfigured from the ski mode to the snowboard mode by (i) pivoting each of the corresponding base plates to at least 75 degrees to release the base plate from the corresponding toe bracket, (ii) connecting the left ski to the right ski, (iii) sliding the left binding onto the front pair of slider blocks and pivoting the pull loop to the lock position, and (iv) sliding the right binding onto the rear pair of slider blocks and pivoting the heel loop to the lock position.

DESCRIPTION OF THE DRAWINGS

The foregoing aspects and many of the attendant advantages of this invention will become more readily appreciated as the same become better understood by reference to the following detailed description when taken in conjunction with the accompanying drawings, wherein.

DETAILED DESCRIPTION

Figure 1:
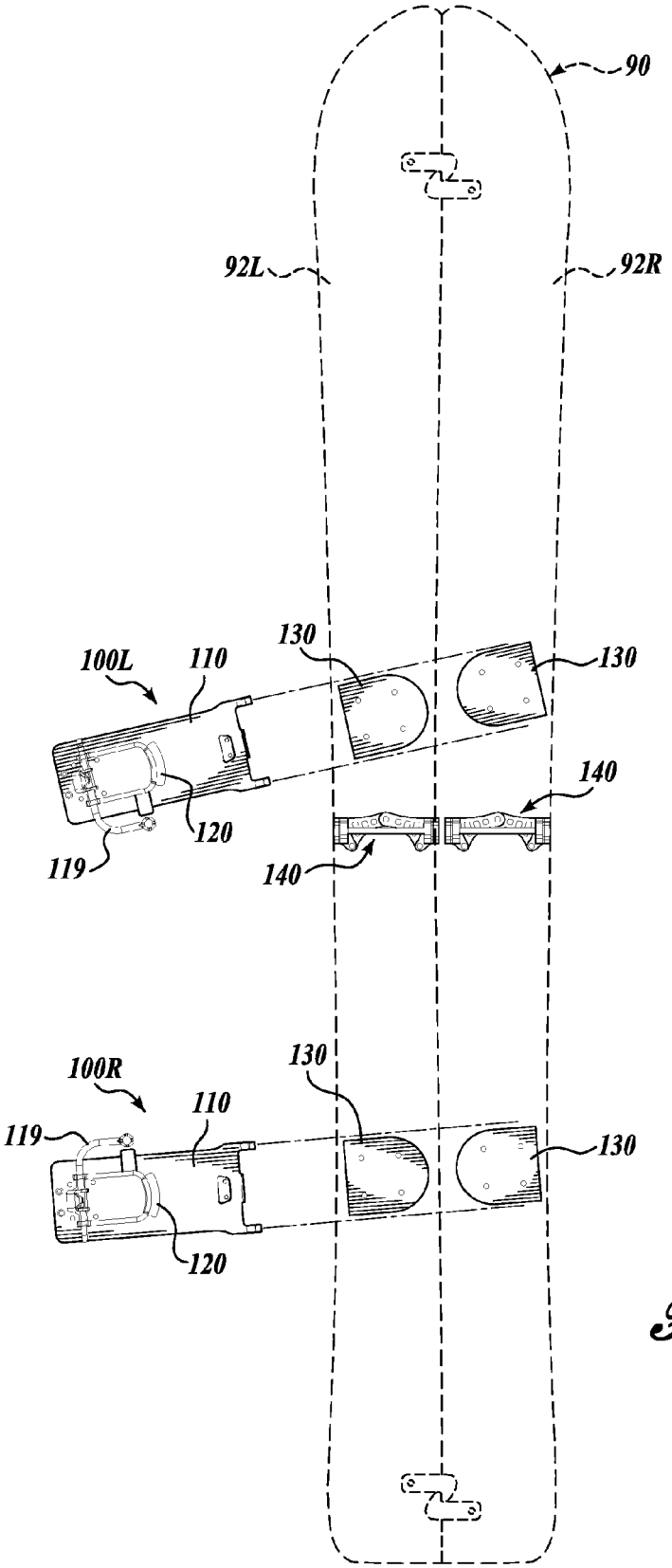
FIG. 1 illustrates a splitboard (in phantom) with a binding system in accordance with the present invention, wherein left and right bindings are positioned to be attached to the splitboard for snowboard mode operation.

A splitboard binding system in accordance with the present invention will now be described with reference to the figures, wherein like numbers indicate like parts. FIG. 1 is a plan view of a splitboard 90 (shown in phantom) comprising a left gliding board 92L and a right gliding board 92R, with a binding system in accordance with the present invention. The splitboard 90 is shown configured for snowboard mode operation in FIG. 1, with the gliding boards 92L, 92R connected together, for example, with interlocking members 93, as are known in the art.

The binding system includes a left binding 100L, a right binding 100R, four slider blocks 130 fixed to separable gliding boards 92L and 92R in aligned pairs, and a pair of toe brackets 140 each fixed to a corresponding gliding board 92L and 92R.

The bindings 100L and 100R in this embodiment include a base plate 110 and conventional step-in binding components for fixing the rider's boot to the binding 100L, 100R. Although the illustrated bindings 100L and 100R are step-in style bindings, it will be apparent to one of skill in the art that the present disclosure may be easily modified for use with a strap-type binding, such as that shown in Wariakois, which is incorporated by reference above. The bindings 100L and 100R are substantially similar, with certain elements mirrored for left- and right-handedness, as will be apparent to persons of skill in the art. Unless otherwise indicated or apparent in the context of the present disclosure, features and aspects described for the left binding 100L apply also to the right binding 100R.

Figure 2:
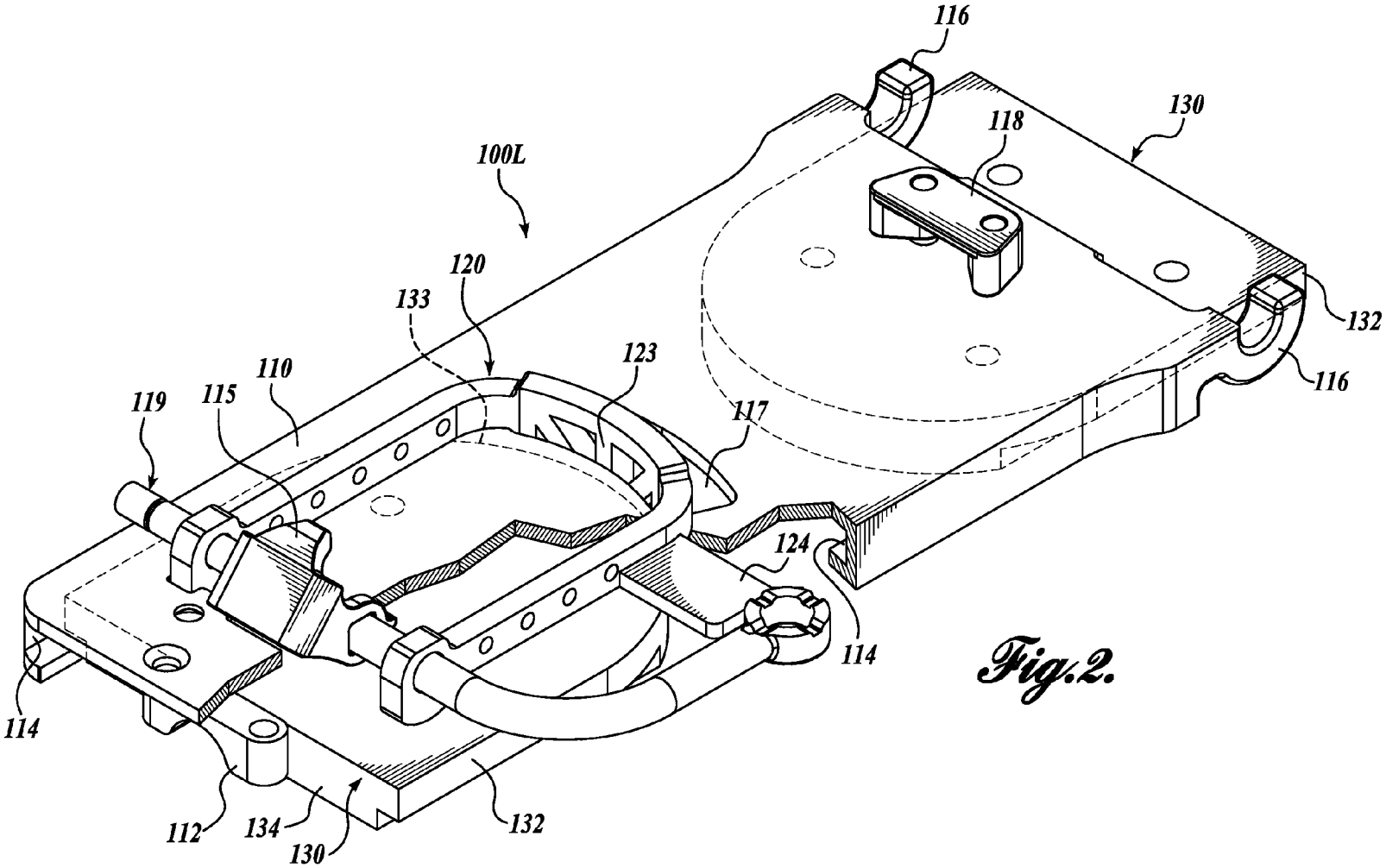
FIG. 2 is a partially cut away perspective view of the left binding shown in FIG. 1, and slidably engaging a pair of slider blocks.

FIG. 2 is a partially cut-away view showing the left binding 100L engaging toe-side and heel-side slider blocks 130 (some attachment hardware, such as pillow blocks and fasteners, are removed throughout for clarity). A heel stop 112 is attached to the back of the base plate 110 and extends downwardly to engage the slider block 130, as discussed below. The front end of the base plate 110 defines a pair of substantially rigid coupling members circular hooks 116. As used herein, "circular" means having a shape corresponding to a portion of a circle. A conventional step-in toe cleat 118 is fixed near a forward end of the base plate 110, and a conventional heel craw 115 is attached to a lever assembly 119 pivotably mounted near a rearward end of the base plate 110.

Figure 3:
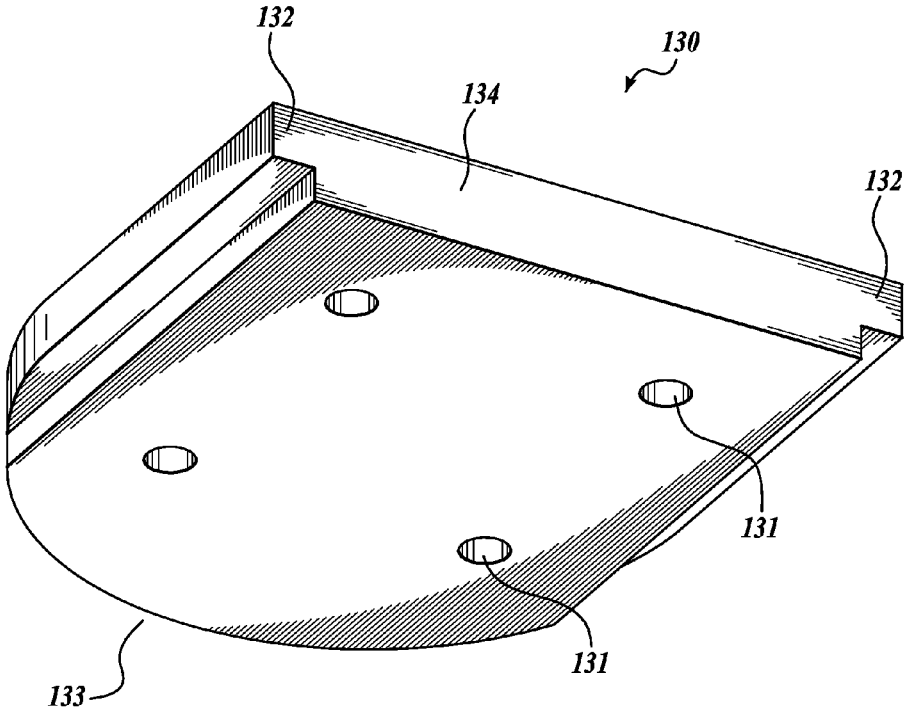
FIG. 3 is a lower perspective view of one of the slider blocks shown in FIG. 1.

In the disclosed embodiment, the toe-side and heel-side slider blocks 130 are identical. A lower perspective view of one slider block 130 is shown in isolation in FIG. 3, and includes apertures 131 for attaching the slider block 130 to the appropriate gliding boards 92L, 92R. Oppositely disposed flanges 132 are defined on either side of the slider block 130, which has a curved first end 133 and a generally straight second end 134.

Referring again to FIG. 2, a portion of the base plate 110 is cut away to illustrate aspects of the assembly. The base plate 110 defines parallel interior channels 114 on either side of the base plate 110. The interior channels 114 are sized and configured to slidably engage the flanges 132 formed on either side of the slider blocks 130. With the slider blocks 130 properly aligned, the base plate 110 slidably engages both the toe-side and the heel-side slider blocks 130, thereby attaching the binding 100L to the splitboard 90, and in particular attaching the binding 100L to both gliding board portions 92L, 92R of the splitboard 90.

Figure 4:
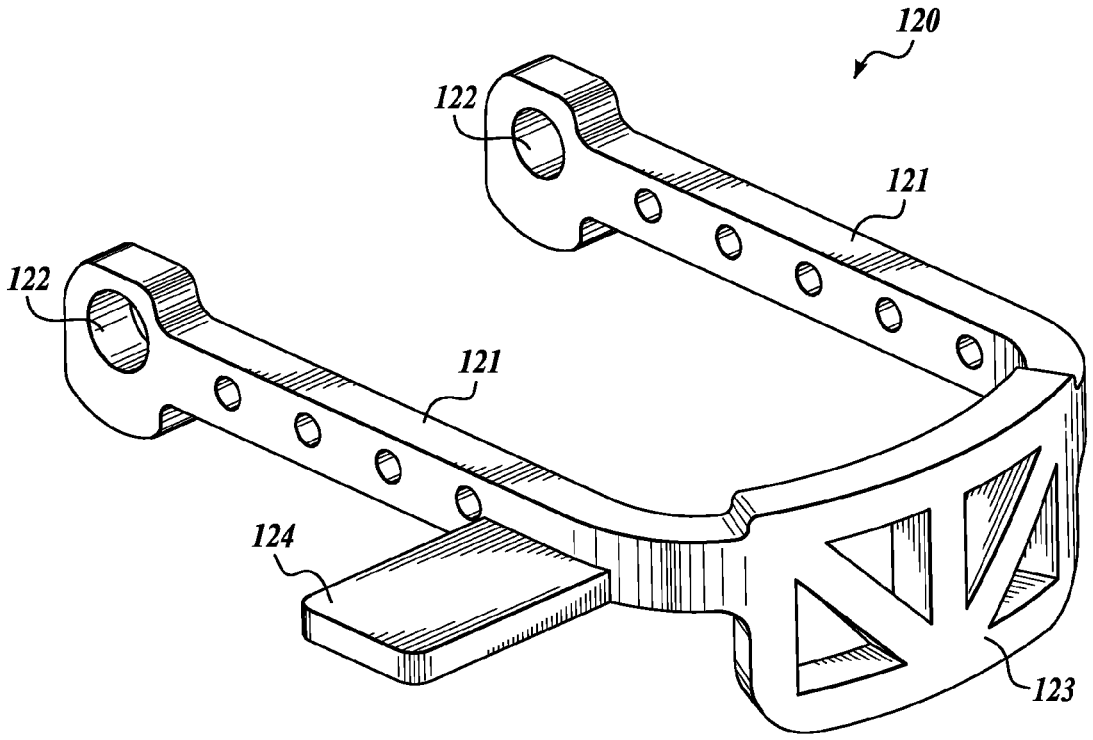
FIG. 4 is a perspective view of the pull loop for the left binding shown in FIG. 2.

A U-shaped pull loop 120 is pivotably attached to the base plate 110 in this exemplary embodiment by attachment to the lever assembly 119 and through pillow blocks (not shown). The pull loop 120 is shown in isolation in FIG. 4. The pull loop 120 includes parallel arms 121, each having a connecting aperture 122 on one end. The parallel arms 121 are connected with a downwardly extending blocking member 123 at the opposite end. Optionally, a tab 124 extends outwardly from one arm 121 to facilitate pivoting the pull loop 120. The blocking member 123 is curved to approximately match the curvature on the curved first end 133 of the slider block 130.

Referring again to FIG. 2, the base plate 110 includes a curved aperture 117 that is sized to receive the blocking member 123 when the pull loop 120 is pivoted to the down position shown. The curved aperture 117 is located just forward of the heel-side slider block 130 when the heel stop 112 abuts the straight second end 134 of the same slider block 130. Therefore, when the pull loop 120 is in the engaged or down position shown in FIG. 2, the blocking member 123 extends through the aperture 117 and engages the curved first end 133 of the heel-side slider block 130. The base plate 110 is, therefore, prevented from sliding forward (by the heel stop 112) or backward (by the blocking member 123) on the slider block 130.

It should be appreciated that the blocking member 123 cannot disengage during use because the rider's boot (not shown) is disposed directly over (e.g., on top of) the pull loop 120. Unlike prior art systems that rely on a removable pin at the front of the base plate 110 to prevent the base plate 110 from sliding along the slider blocks 130 in the binding system shown in FIG. 2, the blocking member 123 cannot be knocked out of engagement from the slider block 130. In addition, in the present invention the base plate 110 may be shorter because it does not have to extend all of the way to engage the front side of the toe-side slider block 130.

To remove the binding from the slider blocks 130, for example, to reconfigure the bindings 100L, 110R from snowboard mode to ski mode operation, e.g., to allow the user to climb a hill, the rider simply disengages from the bindings 100L, 100R, pivots the pull loops 120 generally upwardly to disengage the blocking member 123, and generally rearwardly, to pull the base plate 110 off of the slider blocks 130. It will be appreciated that the user will typically be wearing heavy gloves when reconfiguring the splitboard 100, in snowy conditions and ice encrusting the binding. The pull loop 120 provides a very convenient handle to facilitate pulling the base plate 110 off of the slider blocks 130.

Figure 5:
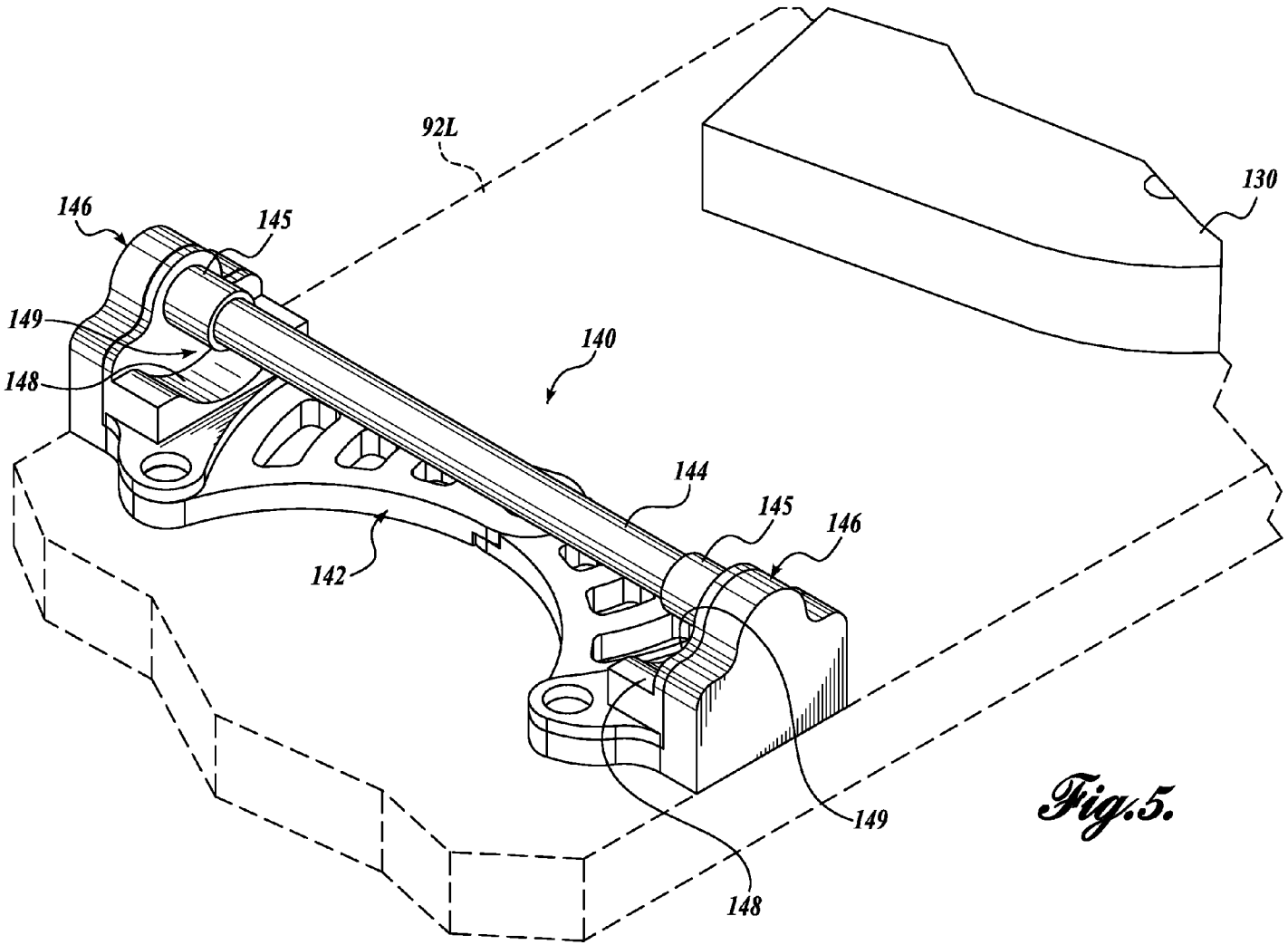
FIG. 5 is a perspective view of one of the toe brackets shown in FIG. 1, with a portion of the gliding board shown in phantom for reference.

As seen in FIG. 1, a toe bracket 140 is attached transversely to each gliding board 92L and 92R. A perspective view of the left-side toe bracket 140 is shown in FIG. 5. The toe bracket 140 includes a base portion 142 that is fixed to the gliding board 92L, and defines oppositely disposed hubs 146. In this embodiment, an optional transverse rod 144 extends between, and is retained by, tubular retainer portions 145 of the hubs 146. The hubs 146 further include saddle portions 148 that define a circular surface that is approximately concentric with the retainer portions 145, to define oppositely disposed circular channels 149 inboard of each hub 146. The channels 149 are configured to slidably receive the rigid hooks 116 defined on the front end of the base plate 110 (FIG. 2).

Figure 6:
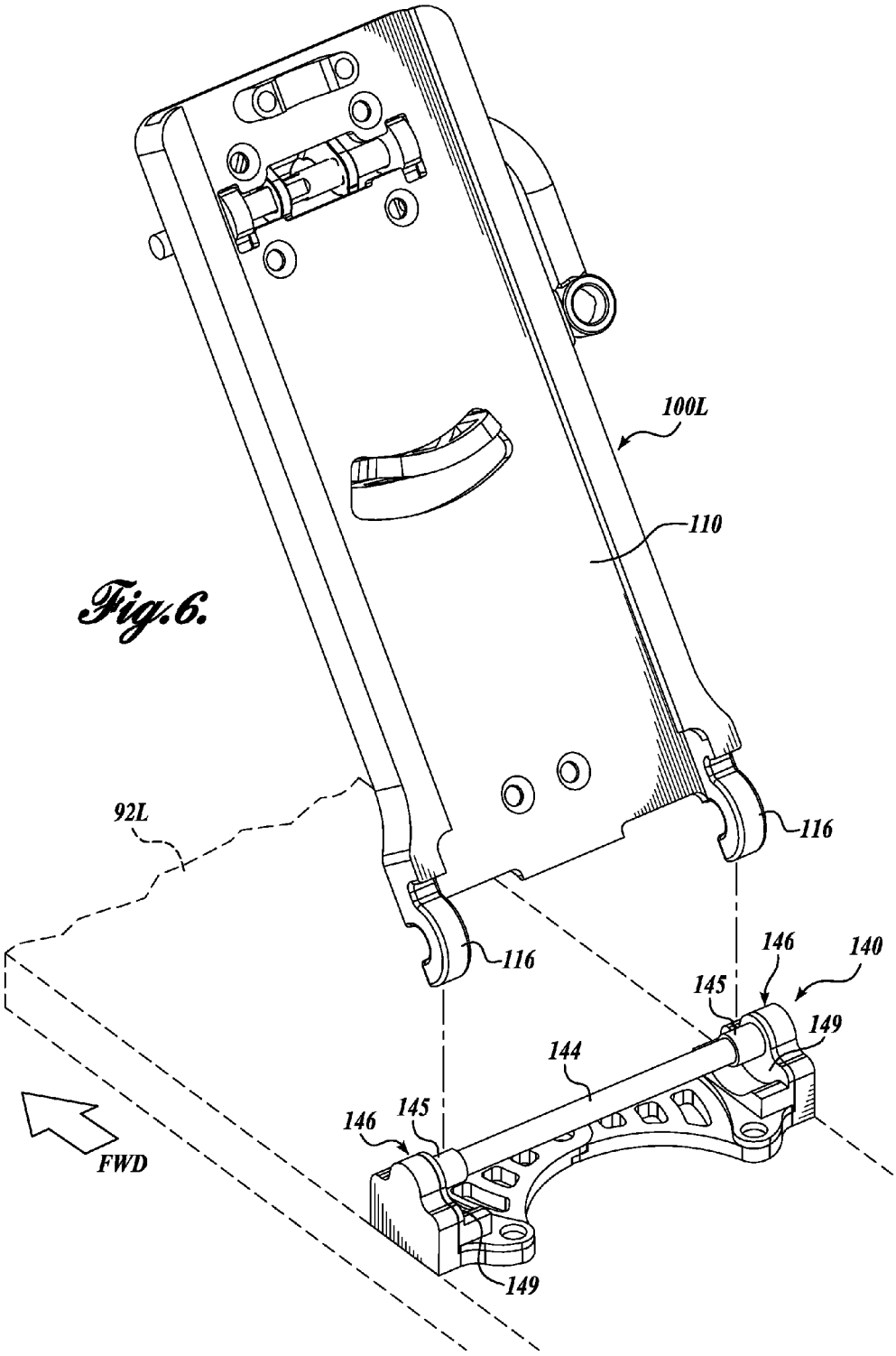
FIG. 6 illustrates engagement of the left binding with the toe bracket for the binding shown in FIG. 1, with a portion of the gliding board shown in phantom for reference.

FIG. 6 shows a rear-left perspective view of the binding 100L, and illustrates attaching the binding 100L to the toe bracket 140. To engage the toe bracket 140, the base plate 110 must be oriented in a rotated position such that the distal ends of the hooks 116 can engage the corresponding tubular retainers 145. The base plate 110 may then be rotated (clockwise in FIG. 6), such that each hook 116 slidably inserts into the corresponding circular channel 149. The user then continues to pivot the binding 100L back toward the gliding board 92L, thereby releasably locking the binding 100L to the toe bracket 140.

Figure 7:
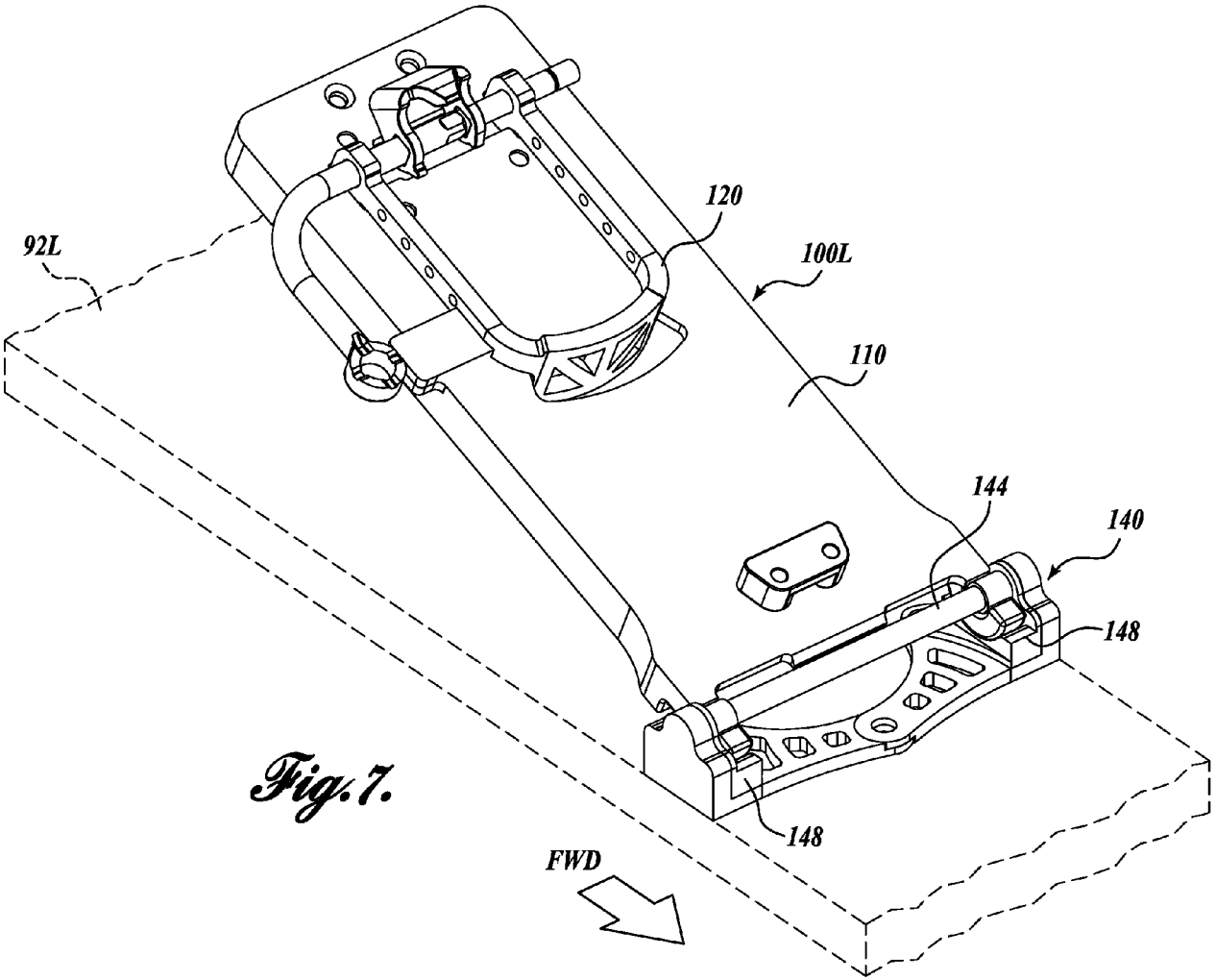
FIG. 7 illustrates the left binding attached to the toe bracket for ski mode operation for the binding system shown in FIG. 1, with a portion of the gliding board shown in phantom for reference.

FIG. 7 shows a front-right perspective view of the binding 100L, showing the base plate 110 engaging the toe bracket 140. As discussed above, when climbing a hill in ski mode, the binding 100L preferably allows the rider's foot to pivot to allow the heel to lift away from the gliding board 92L. The binding 100L is pivotable about the axis defined by the circular channels 149. Optionally, the saddles 148 are formed from a low-friction material, or are provided with a layer of low-friction material, for example from a low-friction polymer, to facilitate pivoting the binding about the rod 144 when climbing in ski mode. As discussed below, the channels 149 and hooks 116 are configured to prevent the base plate 110 from releasing from the toe bracket 140 if the base plate 110 is rotated less than a predetermined amount with respect to the gliding board 92L.

It is also contemplated that an optional locking mechanism may be provided (not shown) that allows the rider to selectively lock the heel end of the binding 100L, 100R to the respective gliding board 92L, 92R, for example, to allow for alpine skiing or the like.

A particular advantage of the bindings 100L and 100R is that the base plates 110 are securely and pivotably attached to the associated toe bracket 140 in ski mode. The base plates 110 will not disengage from the toe bracket 140 unless the base plate 110 is pivoted to or beyond a predetermined angle of rotation. The predetermined angle, or "release angle," of the binding 100L is readily established and is a straightforward design variable. For example, the circumferential length of the hooks 116 may be selected to set the angular orientation of the binding that is required to engage or disengage from the toe bracket 140. If the base plate 110 is rotated to or beyond the release angle, however, the binding 100L, 100R will very easily lift away from the toe bracket 140.

In the current embodiment, the release angle is set to be an angle beyond the range of pivot that a rider would normally experience or generate when using the binding system in ski mode. In one embodiment, the design release angle is set such that, in normal operation, the toe of the user's boots will engage the gliding board before the design release angle is achieved, thereby preventing inadvertent release from the toe bracket 140.

In an exemplary embodiment, the release angle is at least 75 degrees from the lowermost position wherein the base plate 110 abuts or is parallel to, the gliding board 92L. In another embodiment, the release angle is at least 90 degrees from the lowermost position.

Figure 8:
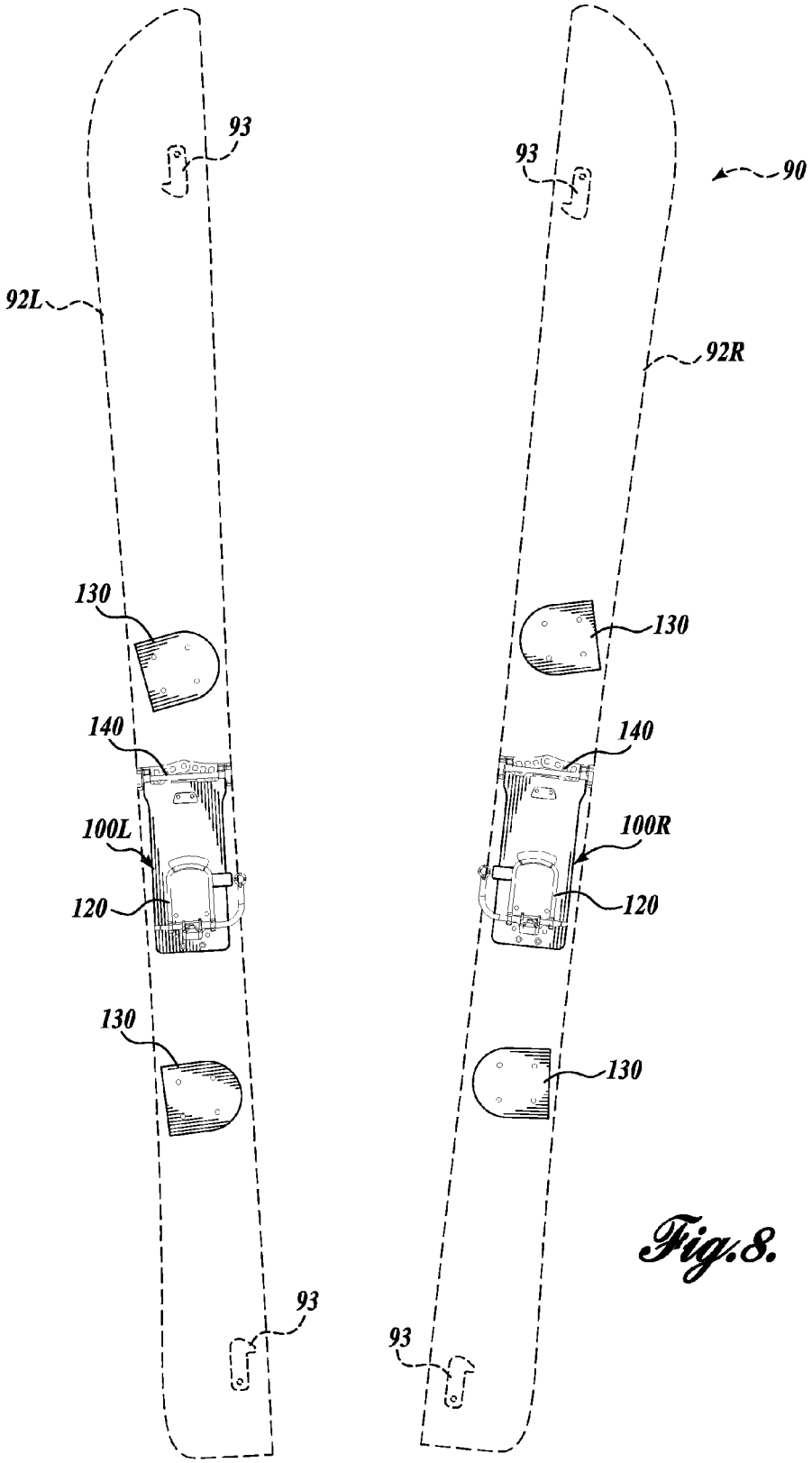
FIG. 8 illustrates the splitboard and binding system shown in FIG. 1, wherein the left and right bindings are reconfigured for ski mode operation.

FIG. 8 shows the splitboard 90 and bindings 100L, 100R reconfigured for ski mode operation, wherein the hook members 93 are disengaged, and the bindings 100L, 100R engage a single respective gliding board 92L, 92R.

To reconfigure the splitboard from snowboard mode to ski mode, the rider (i) disengages from the bindings 100L, 100R, (ii) rotates the pull loops 120 such that the blocking member 123 is generally above the base plate 110, (iii) slides the bindings rearwardly off of the slider blocks 130, (iv) positions the base plates 110 at an angle such that the hooks 116 engage the circular channels 149, (v) disconnects the gliding board hooks 93, and (vi) steps back into or otherwise reengages with the bindings 100L, 100R.

To reconfigure from ski mode to snowboard mode, the rider (i) disengages from the bindings 100L, 100R, (ii) pivots the bindings' base plates 110 and disengages the base plate hooks 116 from the toe brackets 140, (iii) connects the gliding board hooks 93 to join the gliding boards 92L, 92R, (iv) slides the base plates 110 onto the slider blocks 130 until the heel stop 112 abuts the corresponding slider block 130, (v) rotates the pull loops 120 such that the blocking member 123 extends through the apertures 117, and (vi) steps back into the bindings 100L, 100R.

Figure 9:
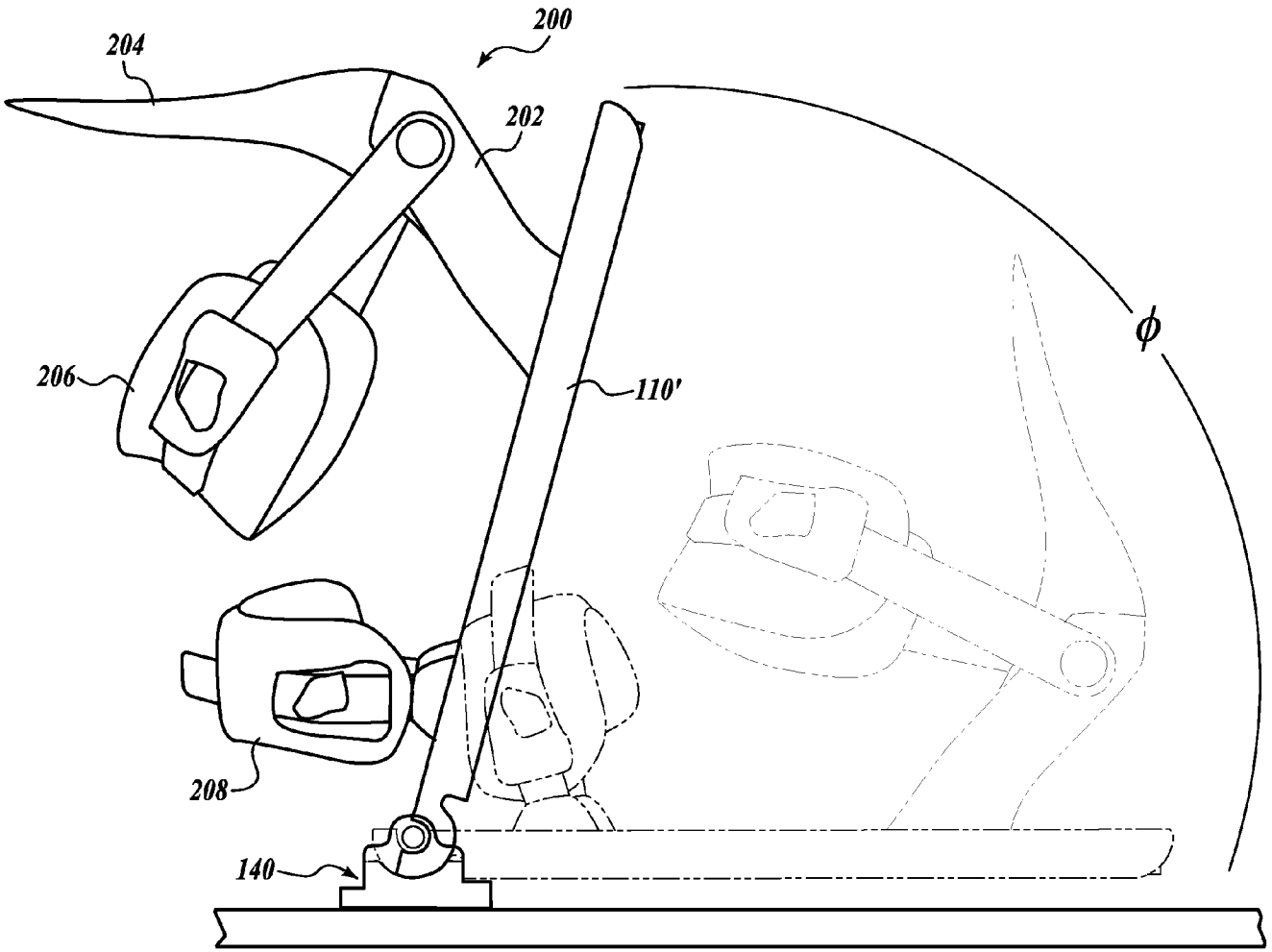
FIG. 9 is a side view of a strap-type embodiment of a binding in accordance with the present invention, shown pivoted to a release angle for disengaging the toe bracket.

FIG. 9 is a side view of a binding 200 similar to the bindings 100L, 100R described above, but comprising a strap-type binding, rather than the step-in binding. In this embodiment the binding 200 includes a base plate 110' that is substantially similar to the base plate 110, described above, except in details related to the strap elements, which are known in the art. In addition, it is contemplated that the pull loop 120, described above, may be pivotable through a smaller angle, to engage and disengage the slider block. The binding 200 further includes a heel loop 202 fixed to the base plate 110', a high back portion 203, which may be pivotably attached to the heel loop 202, a conventional instep strap assembly 204, and a toe strap assembly 206.

The base plate 110' is shown in phantom pivotably engaging the toe bracket 140 for ski mode use, and in solid line, pivoted through to the release angle $\phi$. As discussed above, in an exemplary embodiment the release angle $\phi$ is equal to, or greater than, 75 degrees.

The present binding system provides many advantages over the prior art. The bindings 100L, 100R do not require removal and reinsertion of small components such as locking pins, which can be very difficult in snowy conditions, particularly when wearing gloves. Because no small parts are removed and replaced, the risk of losing such small parts is also avoided. Also, there is no removable pin that could become dislodged during vigorous skiing and boarding activities, or in the event of striking an obstacle while skiing. The pivotable base plate 110 is positively locked to the gliding board during use, but can be easily removed when the splitboard 100 is to be reconfigured between snowboard mode operation and ski mode operation. The pull loop 120 facilitates removal of the binding 100L, 100R from the slider blocks 130 by providing a convenient handle that can be gripped even when wearing snow gloves.

While illustrative embodiments have been illustrated and described, it will be appreciated that various changes can be made therein without departing from the spirit and scope of the invention.

The embodiments of the invention in which an exclusive property or privilege is claimed are defined as follows:

1. A splitboard binding for a splitboard having a left gliding board configured to be releasably attached to a right gliding board, the splitboard binding comprising:

a base plate configured to releasably engage both the right and left gliding boards in a snowboard mode and to releasably engage only a corresponding one of the left and right gliding boards in a ski mode, wherein the base plate includes a first circular hook portion; and a toe bracket attached to the corresponding gliding board, the toe bracket defining a first circular channel, wherein the first circular hook portion is configured to slidably engage the first circular channel such that the base plate is pivotably attached to the toe bracket when the base plate is configured in the ski mode;

wherein the first circular hook portion is releasable from slidably engagement with the first circular channel only when the base plate is disposed at a release angle measured with respect to the corresponding gliding board that is at least 75 degrees.

2. The splitboard binding of claim 1, wherein the release angle is at least 90 degrees.

3. The splitboard binding of claim 1, wherein the toe bracket is fixed to the corresponding gliding board and includes a saddle portion defining an outer wall of the first circular channel, and a circular rod portion defining an inner wall of the first circular channel.

4. The splitboard binding of claim 1, wherein the base plate further comprises a second circular hook portion, and the toe bracket further comprises a second circular channel, wherein the first and second circular hook portions are configured to releasably engage the first and second circular channels when the binding is configured in the ski mode.

5. The splitboard binding of claim 4, wherein the toe bracket comprises a left hub having a left saddle portion and a left tubular portion, and a right hub having a right saddle portion and a right tubular portion.

6. The splitboard binding of claim 5, wherein the toe bracket further comprises a rod having a first end attached to the left tubular portion and a second end attached to the right tubular portion.

7. The splitboard binding of claim 1, wherein the binding further comprises a left slider block fixed to the left gliding board, and a right slider block fixed to the right slider board, wherein the base plate is configured to slidably engage the left and right slider blocks when the base plate is configured in the snowboard mode, and further comprising means for preventing the base plate from sliding along the left and right slider blocks during use.

8. The splitboard binding of claim 7, wherein the means for preventing the base plate from sliding comprises a blocking element pivotably attached to the base plate, and configured to engage a front end of one of the left and right slider blocks, and a heel stop fixed to the base plate and configured to engage a back end of one of the left and right slider blocks.

9. The splitboard binding of claim 7, wherein the base plate further comprises a heel stop fixed to a back end of the base plate, and a pull loop pivotably attached to the base plate that is pivotable between a lock position wherein the base plate is fixedly positioned on the left and right slider blocks, and a release position wherein the base plate is slidable on the left and right slider blocks.

10. The splitboard binding of claim 7 wherein the means for preventing the base plate from sliding comprises a blocking element that extends through an aperture in the base plate, and further wherein the blocking element is configured to be held in place by the user's boot during use.

11. A splitboard comprising:

a left gliding board and a right gliding board, wherein the left gliding board is configure to be selectively connected to the right gliding board;

a left toe bracket fixedly attached to the left gliding board, the left toe bracket defining a left circular channel;

a right toe bracket fixedly attached to the right gliding board, the right toe bracket defining a right circular channel;

a left binding comprising a base plate having a circular hook configured to slidably engage the left circular channel such that the base plate is pivotably attached to the left gliding board;

a right binding comprising a base plate having a circular hook configured to slidably engage the right circular channel such that the base plate is pivotably attached to the right gliding board; and means for selectively attaching each of the left binding and the right binding to both the right gliding board and the left gliding board;

wherein the left binding base plate is configured to release from pivotable attachment to the left gliding board only if the left binding base plate is pivoted beyond a predetermined release angle, and further wherein the right binding base plate is configured to release from pivotable attachment to the right gliding board only if the right binding base plate is pivoted beyond the predetermined release angle.

12. The splitboard of claim 11, wherein the predetermined release angle is at least 75 degrees.

13. The splitboard of claim 11, wherein the left toe bracket includes a saddle portion defining an outer wall of the left circular channel, and a circular rod portion defining an inner wall of the left circular channel.

14. The splitboard of claim 11, wherein the left binding base plate further comprises a second circular hook, and the left toe bracket further comprises a second left circular channel, wherein the second circular hook is configured to releasably engage the second circular channel.

15. The splitboard of claim 14, wherein the left toe bracket comprises a left hub having a left saddle portion and a left tubular portion, and a right hub having a right saddle portion and a right tubular portion.

16. The splitboard of claim 15, wherein the left toe bracket further comprises a rod having a first end attached to the left tubular portion and a second end attached to the right tubular portion.

17. The splitboard of claim 11, wherein the means for selectively attaching each of the left binding and the right binding to both the right gliding board and the left gliding board comprises a front pair of slider blocks fixed to the left and right gliding boards and a back pair of slider blocks fixed to the left and right gliding boards, wherein the left binding base plate is configured to slidably engage the front pair of slider blocks when the left and right gliding boards are connected, and the right binding base plate is configured to slidably engage the back pair of slider blocks when the left and right gliding boards are connected.

18. The splitboard of claim 17, further comprising a left pull loop pivotably attached to the left binding base plate and pivotable between a lock position wherein the left pull loop engages one of the front pair of slider blocks, and a release position wherein the pull loop is disposed away from the front pair of slider blocks.

19. The splitboard of claim 18, wherein the left binding base plate further comprises a heel stop fixed to a back end of the base plate and an intermediate aperture, and wherein the pull loop comprises a blocking element configured to extend through the intermediate aperture when the pull loop is in the lock position.

20. A splitboard assembly comprising:

a left ski having a left toe bracket defining a first circular channel;

a right ski having a right toe bracket defining a second circular channel, wherein the left ski is releasably securable to the right ski for use in a snowboard mode;

a front pair of slider blocks attached to the left and right skis, and a rear pair of slider blocks attached to the left and right skis;

a left binding configured to selectively engage the front pair of slider blocks in the snowboard mode and to pivotably engage the left toe bracket in a ski mode, the left binding comprising a base plate having a circular hook portion configured to releasably engage the first circular channel, an intermediate aperture, and a pull loop pivotably attached to the base plate and pivotable between a lock position and a release position, the pull loop having a blocking member configured to extend through the aperture when the pull loop is pivoted to the lock position; and a right binding configured to selectively engage the rear pair of slider blocks in the snowboard mode and to pivotably engage the right toe bracket in the ski mode, the right binding comprising a base plate having a circular hook portion configured to releasably engage the second circular channel, an intermediate aperture, and a pull loop pivotably attached to the base plate and pivotable between a lock position and a release position, the pull loop having a blocking member configured to extend through the aperture when the pull loop is pivoted to the lock position;

wherein the left and right bindings are structured to be reconfigured from the ski mode to the snowboard mode by (i) pivoting each of the corresponding base plates to at least 75 degrees to release the base plate from the corresponding toe bracket, (ii) connecting the left ski to the right ski, (iii) sliding the left binding onto the front pair of slider blocks and pivoting the pull loop to the lock position, and (iv) sliding the right binding onto the rear pair of slider blocks and pivoting the heel loop to the lock position.

* * * * *

UNITED STATES PATENT AND TRADEMARK OFFICE

CERTIFICATE OF CORRECTION

PATENT NO. : 8,764,043 B2
APPLICATION NO. : 13/922161
DATED : July 1, 2014
INVENTOR(S) : J. Neubauer et al.

It is certified that error appears in the above-identified patent and that said Letters Patent is hereby corrected as shown below:

In the Claims

| COLUMN | LINE | |
|---|---|---|
| 8 (Claim 1, | 5 line 16) | "slidably" should read --slidable-- |
| 8 (Claim 11, | 61 line 3) | "configure" should read --configured-- |

Signed and Sealed this
Ninth Day of December, 2014

Michelle K. Lee

Michelle K. Lee
*Deputy Director of the United States Patent and Trademark Office*